US005522181A

United States Patent [19]

Ellsworth

[11] Patent Number: 5,522,181

[45] Date of Patent: Jun. 4, 1996

[54] DEVICES FOR THE RAPID DEPLOYMENT OF IGLOOS

[76] Inventor: Thayne N. Ellsworth, 1424 W. 1100 North, Provo, Utah 84604

[21] Appl. No.: 249,466

[22] Filed: May 26, 1994

[51] Int. Cl.[6] ..... E04G 11/04; B28B 7/32

[52] U.S. Cl. ..... 52/2.15; 52/199; 135/904; 249/65

[58] Field of Search ..... 52/2.15, 2.22, 52/198, 199; 135/904; 264/314, 3; 249/65; 224/153

[56] References Cited

U.S. PATENT DOCUMENTS

| | | | |
|---|---|---|---|
| 1,219,905 | 3/1917 | Barringer | 135/904 |
| 2,324,554 | 7/1943 | Billner | 249/65 |
| 3,462,521 | 8/1969 | Bini | 264/314 |
| 4,622,887 | 11/1986 | Peterson | 52/198 |
| 5,062,557 | 11/1991 | Mahvi et al. | 224/153 |

*Primary Examiner*—Michael Safavi

[57] ABSTRACT

Apparatus for fabricating igloo and like structures comprising an inflatable form of a flexible air-impervious plastic having a base component, a roof component, and cylindrically shaped side walls with associated valve to inflate and deflate the form. The form is utilized with a chimney to create an igloo structure. During transport the form can be stored in a tubular canister and, along with the chimney, carried within a backpack.

1 Claim, 6 Drawing Sheets

DEVICES FOR THE RAPID DEPLOYMENT OF IGLOOS

BACKGROUND OF THE INVENTION

1. Field of the Invention

The present invention relates to devices for the rapid deployment of igloos and more particularly pertains to the deploying of igloos more efficiently, conveniently and quickly through an inflatable form.

2. Description of the Prior Art

The use of building forms is known in the prior art. More specifically, building forms heretofore devised and utilized for the purpose of fabrication structures are known to consist basically of familiar, expected, and obvious structural configurations, notwithstanding the myriad of designs encompassed by the crowded prior art which has been developed for the fulfillment of countless objectives and requirements.

The prior ark discloses a large number of devices for fabricating structures. By way of example, U.S. Pat. Nos. 3,452,494 to Prior and 3,619,432 to Harrington disclose rapidly deployed buildings with hemispherical and cylindrical shapes.

U.S. Pat. Nos. 3,643910 to Helfetz and 3,909,992 to Stachiw disclose the inflation of a dome-like structure, the Helfetz structure adapted to function as a form for receiving further materials.

U.S. Pat. No. 4,154,423 to Crock discloses forms for making blocks for fabricating an igloo.

In this respect, the devices for the rapid deployment of igloos according to the present invention substantially departs from the conventional concepts and designs of the prior art, and in doing so provides an apparatus primarily developed for the purpose of the deploying of igloos more efficiently, conveniently and quickly through an inflatable form and a pump.

Therefore, it can be appreciated that there exists a continuing need for new and improved devices for the rapid deployment of igloos which can be used for the deploying of igloos more efficiently, conveniently and quickly through an inflatable form and a pump. In this regard, the present invention substantially fulfills this need.

SUMMARY OF THE INVENTION

In view of the foregoing disadvantages inherent in the known types of building forms now present in the prior art, the present invention provides an improved device for the rapid deployment of igloos. As such, the general purpose of the present invention, which will be described subsequently in greater detail, is to provide a new and improved device for the rapid deployment of igloos and a method which has all the advantages of the prior art and none of the disadvantages.

To attain this, the present invention essentially comprises a new and improved apparatus for fabricating an igloo and like structures comprising, in combination, an inflatable form apparatus for fabricating a igloo and like structures comprising of an inflatable form of flexible air-impervious plastic having an in base component, a roof component, and cylindrically shaped side walls.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved devices for the rapid deployment of igloos which have all the advantages of the prior art building forms and none of the disadvantages.

It is another object of the present invention to provide new and improved devices for the rapid deployment of igloos which may be easily and efficiently manufactured and marketed.

It is a further object of the present invention to provide new and improved devices for the rapid deployment of igloos which are of durable and reliable constructions.

An even further object of the present invention is to provide new and improved devices for the rapid deployment of igloos which are susceptible of a low cost of manufacture with regard to both materials and labor, and which accordingly are then susceptible of low prices of sale to the consuming public, thereby making such devices for the rapid deployment of igloos economically available to the buying public.

Still yet another object of the present invention is to provide new and improved devices for the rapid deployment of igloos which provide in the apparatuses and methods of the prior art some of the advantages thereof, while simultaneously overcoming some of the disadvantages normally associated therewith.

Even still another object of the present invention is to deploy igloos more efficiently, conveniently and quickly through an inflatable form.

Lastly, it is an object of the present invention to provide a new and improved apparatus for fabricating an igloo and like structures comprising an inflatable form apparatus for fabricating an igloo and like structures comprising of an inflatable form of a flexible air-impervious plastic having a base component, a roof component and cylindrically shaped side walls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
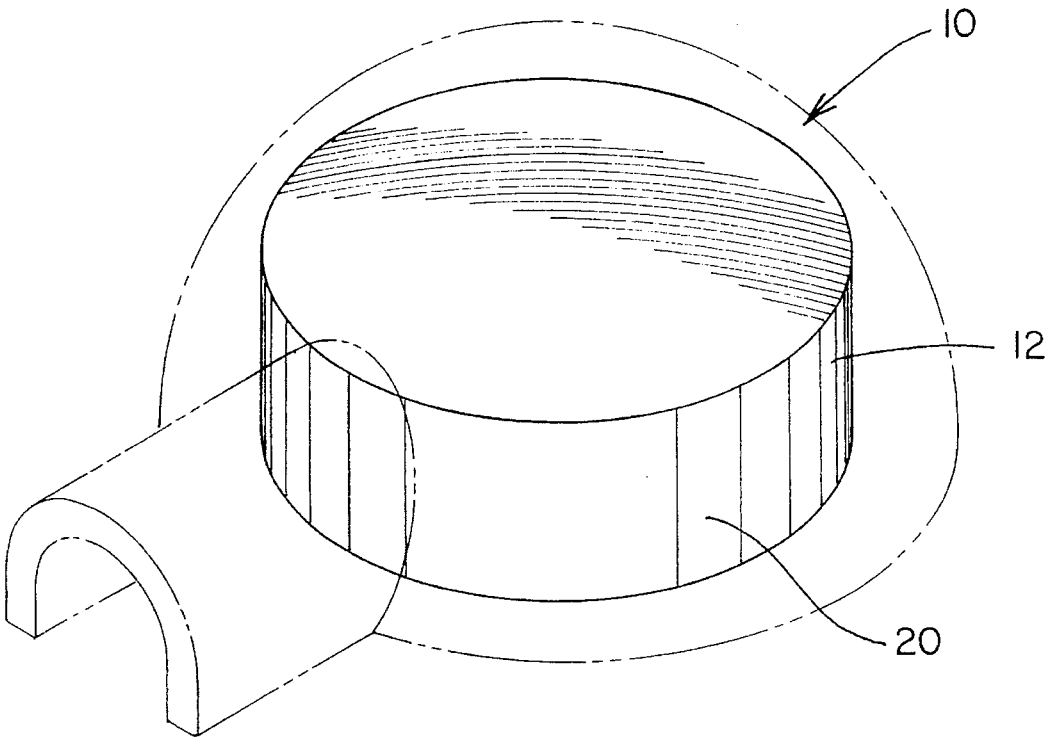
FIG. 1 is a perspective view of the new and improved device for the rapid deployment of an igloo constructed in accordance with the principles of the present invention shown with an igloo formed in association therewith.
Figure 2:
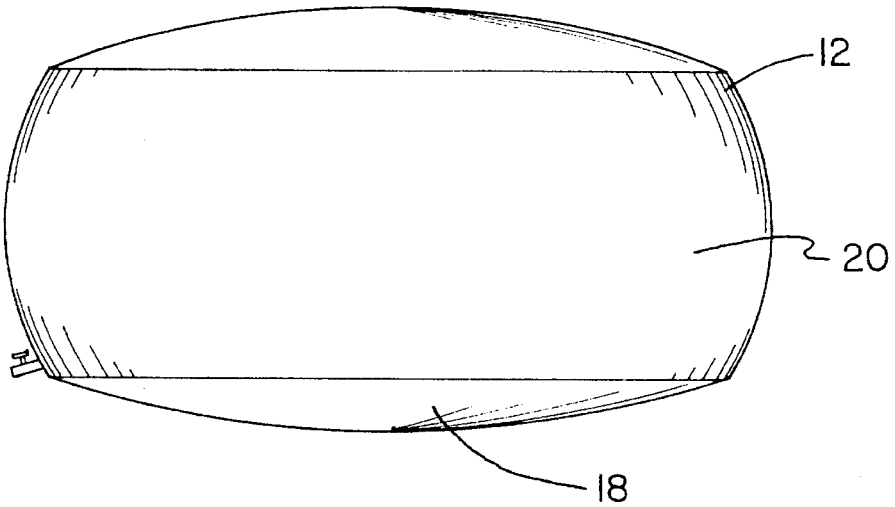
FIG. 2 is a side elevational view of the form shown in FIG. 1.

With reference now to the drawings, and in particular to FIG. 1 thereof, the preferred embodiment of the new and improved devices for the rapid deployment of igloos embodying the principles and concepts of the present invention and generally designated by the reference numeral 10 will be described.

As can be readily seen in FIGS. 1 through 4, the system 10 of the present invention includes a form 12. More specifically, the form is fabricated of an inflatable, flexible, air-impervious material. The preferred material is plastic, more preferably polyurethane. Other acceptable plastics with like include properties could be utilized.

The form has a generally horizontal circular base 18 and a circular top 14 with a cylindrical side wall 20 extending vertically therebetween. The base and upper component form the shape of the room of the igloo to be fabricated. The upper, lower, and intermediate side components are sealed together as by heat sealing to hold air when inflated. Other forms of coupling such as stitching and adhesives could be utilized.

The cylindrical side walls are shown as being fabricated as a right circular cylinder. The side walls, however, need not be right circular cylinder of shown. The cylindrical side walls could take the form of a rectangular configuration with rectangular top and base components. In this manner the formed room would be box-like in configuration.

A hose or tube 30 is formed in the form adjacent to the base with a valve 32 positioned in the tube 30. In this manner the valve and tube function to inflate and deflate the form. For inflation, the tube 30 is coupled at its exterior end to a pump or source of compressed air to effect inflation as needed.

Figure 3:
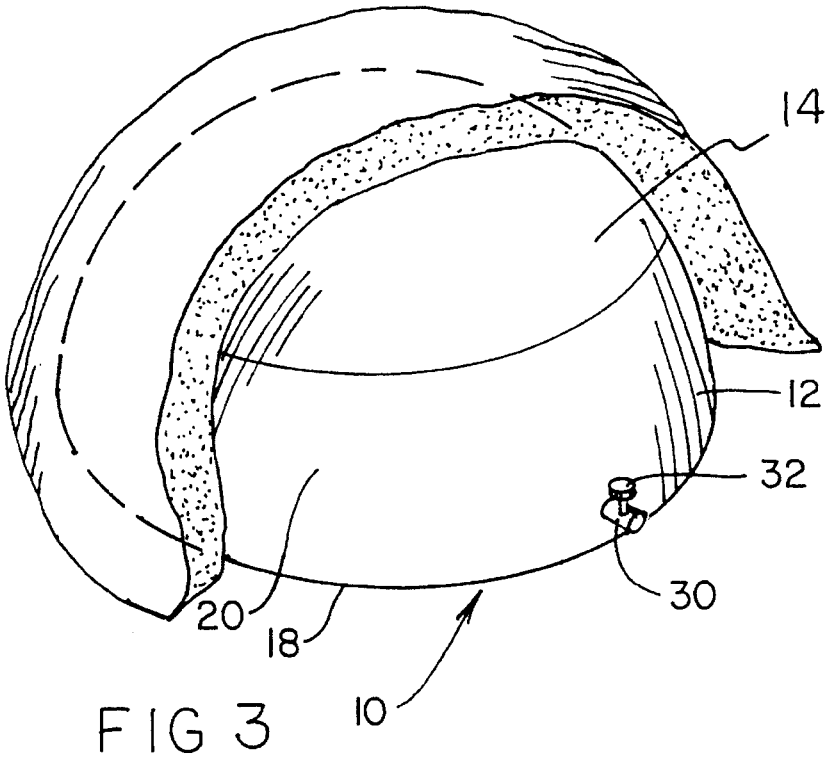
FIG. 3 is a perspective view of the form deployed in association with a partially fabricated igloo.
Figure 4:
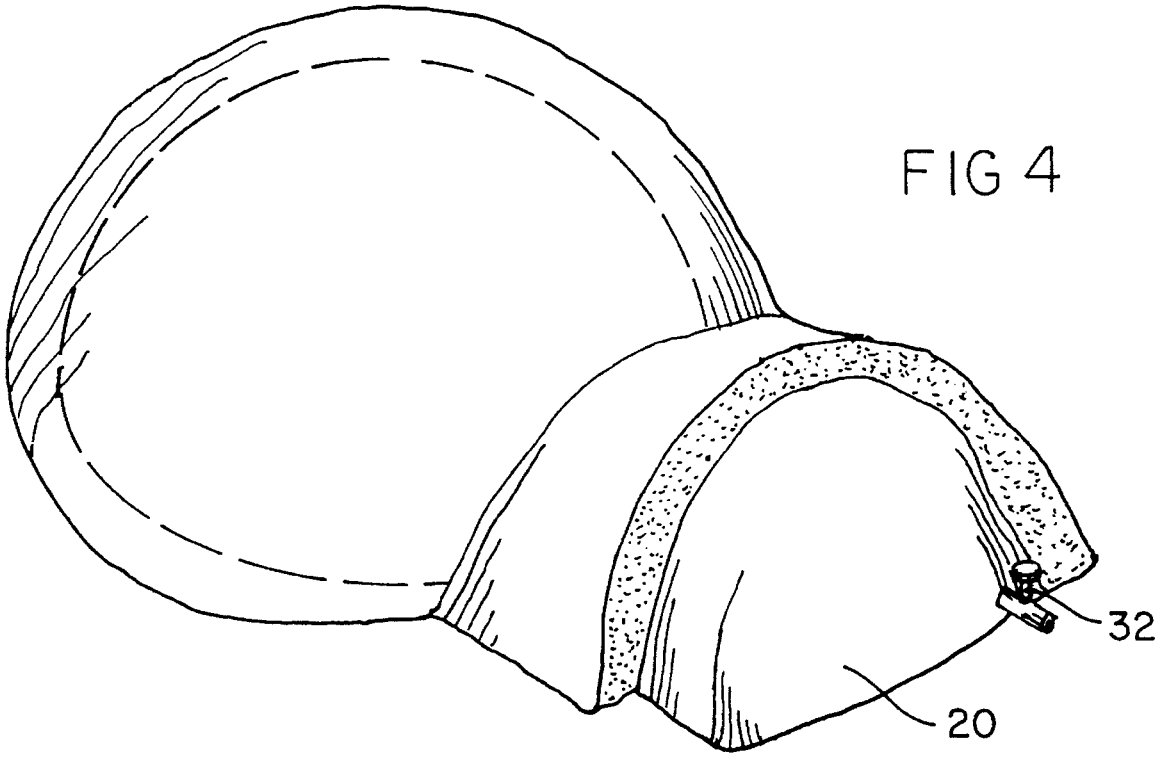
FIG. 4 is a perspective view of the form deployed for fabricating an entry for the igloo.

For fabricating the igloo, the form is fully inflated as shown in FIG. 3. Prior to completely covering the form with snow, the form is deflated and removed. It is then placed adjacent to an entrance. Thereafter the form is partially inflated and covered with snow to form an entrance. Note FIG. 4. The form is then deflated and removed leaving the igloo free standing.

Figure 5:
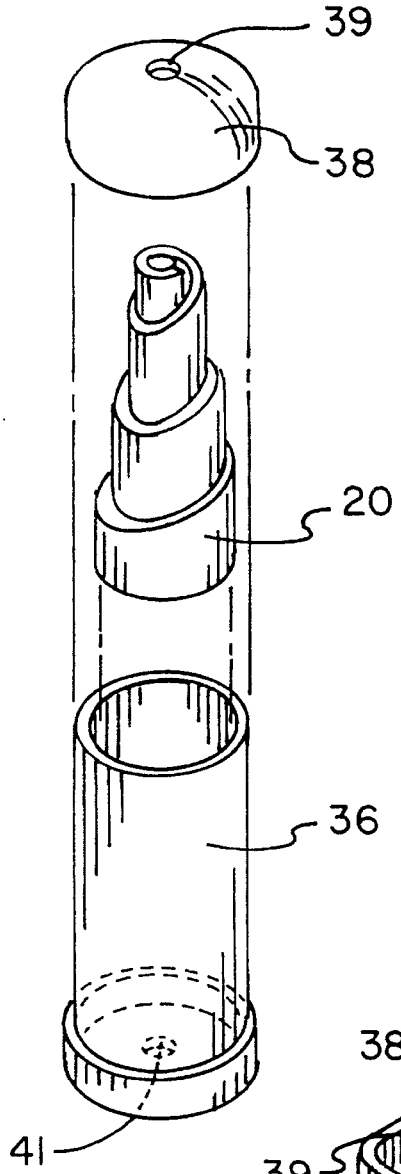
FIG. 5 is a perspective view of a form folded and wrapped being positioned in a container.
Figure 6:
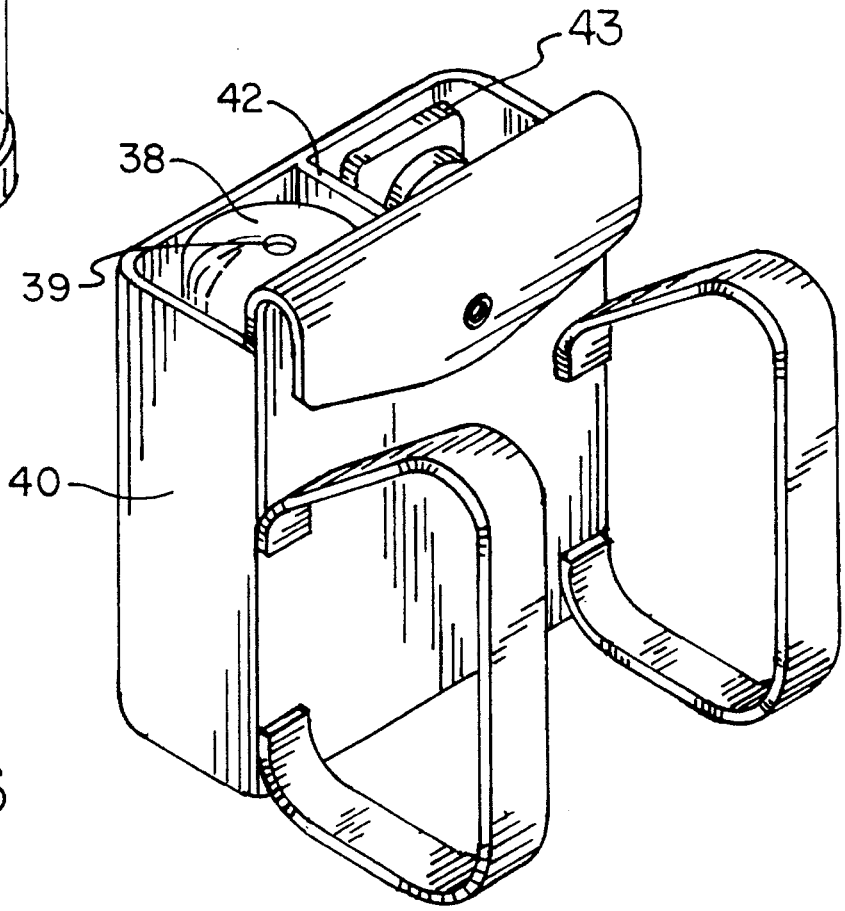
FIG. 6 is a perspective view of a form in a container, and associated component positioned in a backpack.

In an alternate embodiment of the invention as shown in FIGS. 5 and 6, the form 12 may be rolled up and inserted in a tubular canister 36 for storage and transportation purposes. A lid 38 positionable on the open end of the canister is used for sealing the form in the canister to keep it dry. A hole 39 is formed in the central top of the lid for drainage. A similar hole 41 is formed in the central bottom of the canister.

In addition, a knapsack or backpack 40 is provided. Note FIG. 6. The knapsack is conventional in construction except for a divider wall 42 within the container portion of the backpack 40. In this manner, the canister with the form may be supported to one side of the divider wall 42. In addition, a supplemental component 43 may be supported to the other side of the divider wall 42. Such supplemental component may be a chimney, a pump, a container of compressed air, or the like.

Figure 7:
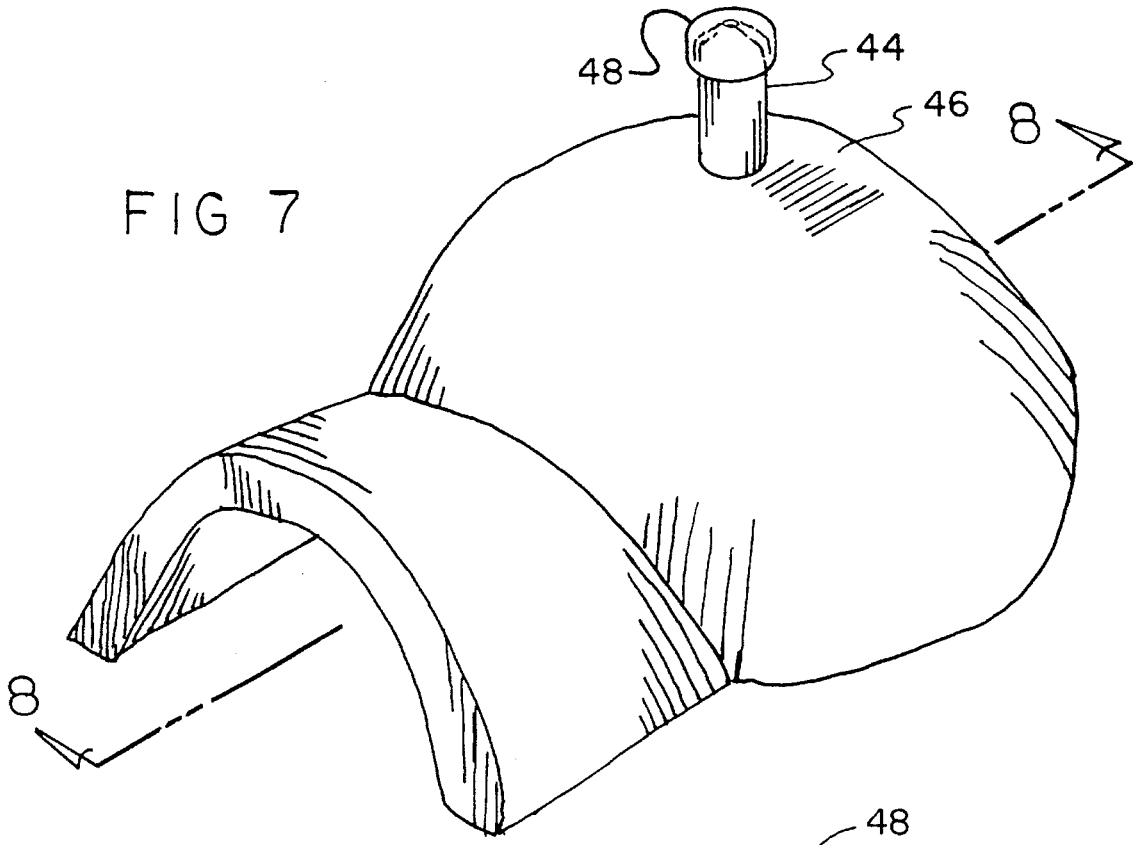
FIG. 7 is a perspective view of an igloo constructed in accordance with an embodiment of the invention.
Figure 8:
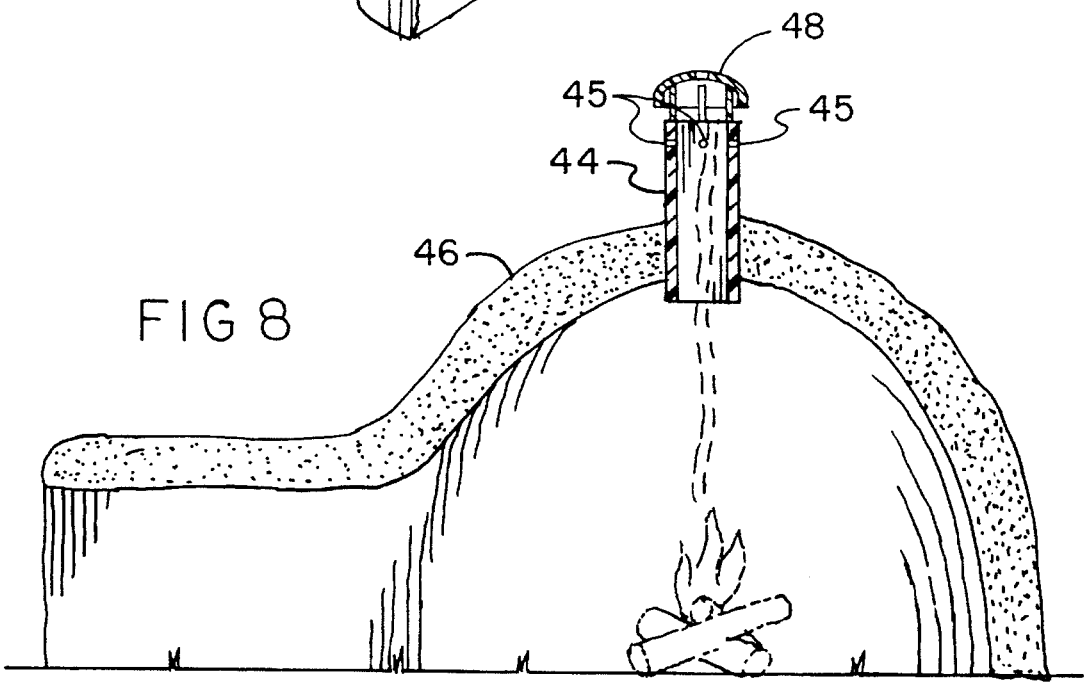
FIG. 8 is a sectional view of the prior Figure taken along line 8—8 of FIG. 7.
Figure 9:
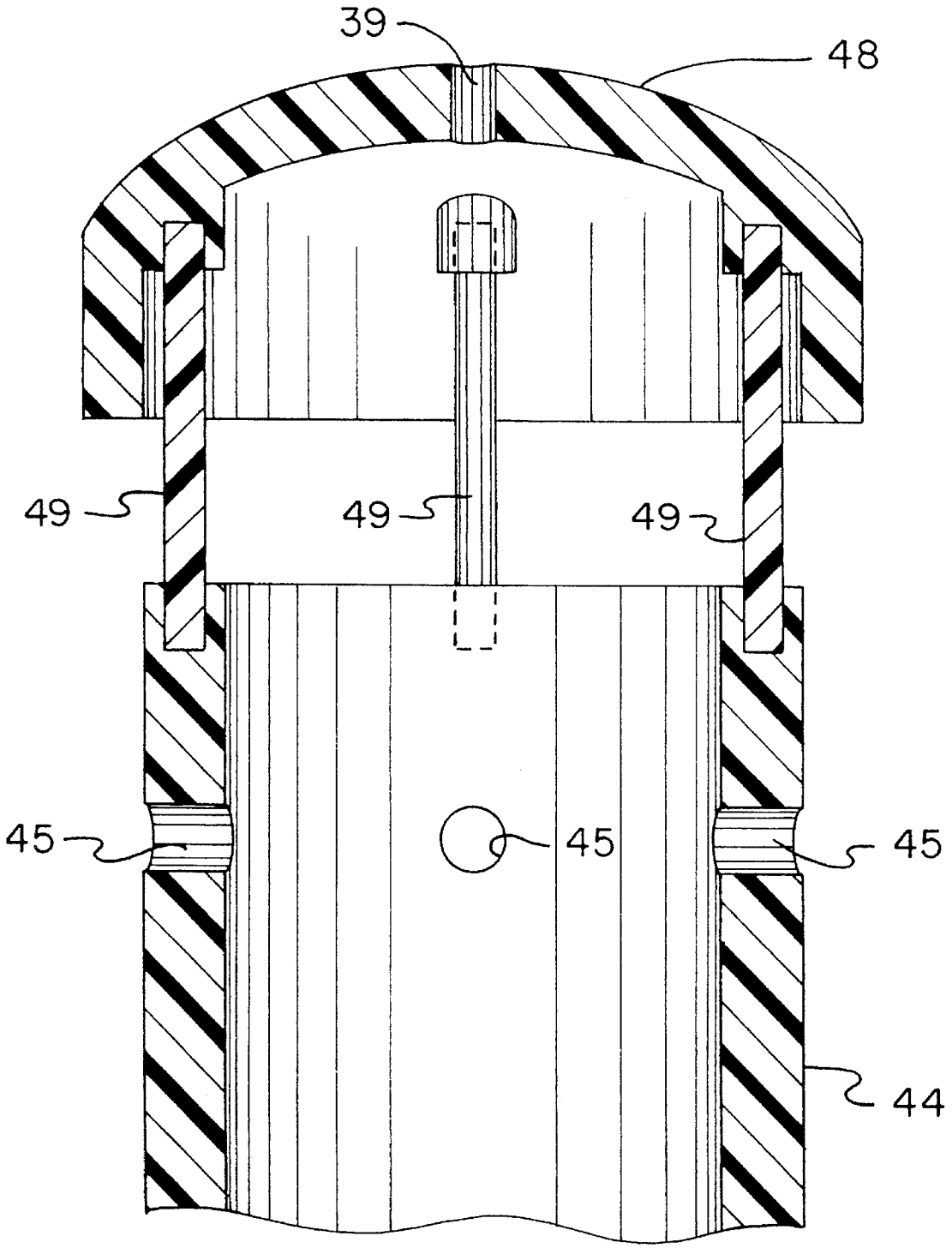
FIG. 9 is a cross-sectional view taken vertically through the center of the chimney.

FIGS. 7 and 8 illustrate the final embodiment of the invention as well as the igloo fabricated in accordance with the principles of the present invention. Such final embodiment includes a tubular member 44 positionable centrally in the top of the formed igloo 46. So positioned, the tube 44 functions as a chimney. A cap 48 spaced above the tube functions to preclude the entering of rain or snow into the igloo. The cap 48 and/or chimney 44 are preferably fabricated of a rigid transparent plastic material for admitting light into the igloo. Holes 45 are preferably formed adjacent to the top of the chimney to promote the circulation of air. In addition, the cap 48 is held in position on the top of the chimney 44 through vertical connector rods 49 with spaces therebetween, again for the purpose of promoting the circulation of air. Note FIG. 9.

Figure 10:
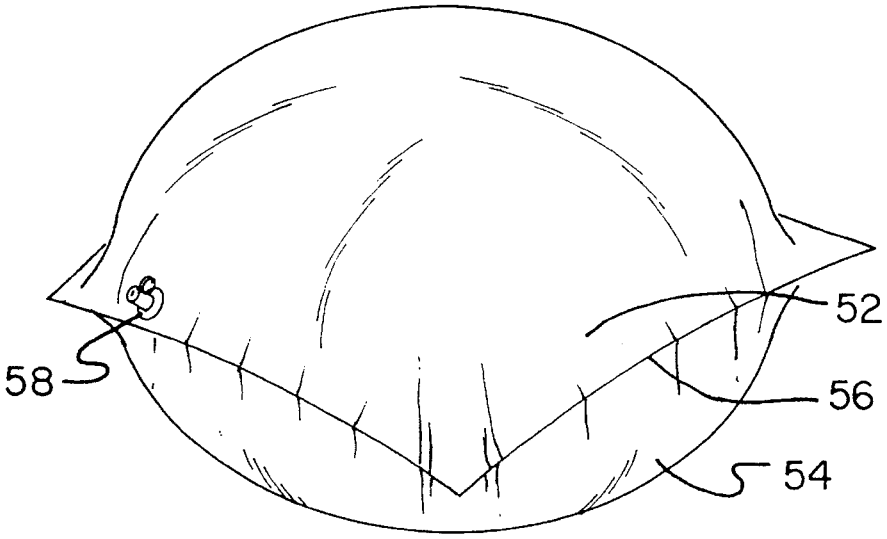
FIG. 10 is a perspective view of a form fabricated in accordance with an alternate embodiment of the invention.
Figure 11:
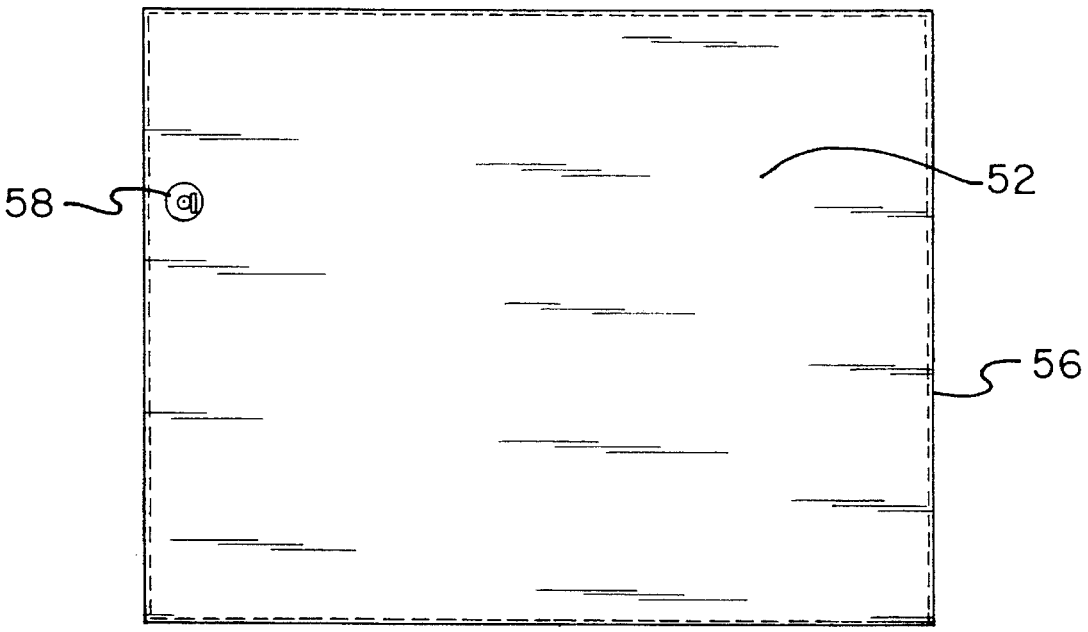
FIG. 11 is a top plan view of the form illustrated in FIG. 10.

An alternate embodiment of the invention is shown in FIGS. 10 and 11. In such embodiment a rectangular top component 52 is coupled to a rectangular base component 54 around their peripheries. The adjacent peripheries are coupled in an air impervious relationship as by head sealing. This forms a seam 56. A valve 58 extends through one of the components for inflating and deflating the form.

In this embodiment, the initial sheets are rectangular. They may be two rectangular panels of the same size with heat sealing around the entire periphery. In the alternative, however, a single elongated rectangular sheet may be employed and overlapped at a center line through the middle of the long edges. Heat sealing would be done on the three overlapped free edges. The valve is then inserted. When inflated with air the device takes on a lozenge shape, like an over stuffed pillow. At its fullest, it is nearly circular in cross sectional approaching spherical in shape, but with a slight elongation in overall appearance.

The present invention is an inflatable polyurethane form that is designed to serve as a temporary frame for building igloos. It provides a relatively quick and easy way to construct an igloo while at the same time offering the advantages of being lightweight and easy to transport and store.

The present invention features plastic air valves so the form can be inflated and deflated, and is made of a polyurethane film that remains flexible down to −100 degrees Fahrenheit, and has a 97 percent memory retention. The material also has an incredible 9,000 p.s.i. tensile strength.

To use the present invention, you fill the inflator with air. Next, connect the air line to the pattern and fill it by compressing the inflator. The pattern should be filled so that its diameter is no larger than 48 inches. Taking care to avoid sharp objects that might puncture it, place the pattern in the desired location and cover it with snow. The walls of your igloo should be made firm and between 6 and 12 inches thick. Deflate the pattern slightly and relocate it to form the entrance, and again, cover the pattern with snow. Finally, deflate and remove the pattern.

Outdoors people, winter enthusiasts, and others will no doubt have an interest in this product. It streamlines the process of building an igloo considerably without adding significantly to the amount of equipment that must be carried.

Note is taken that the form when deflated may be used as a ground cloth after the igloo is fully formed. No fire, however should be made on the form. Further, the back pack may be used as a door for the igloo.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved apparatus for fabricating an igloo and like structures comprising, in combination:

an inflatable form of a flexible air-impervious polyurethane material having a rectangular top component, a rectangular base component and cylindrical side walls therebetween, the top and base components being shaped in an arched configuration with the form being in an inflated orientation;

an inflation hose coupled to the side walls of the form for the inflation thereof with a valve coupled with respect to the hose;

a tubular container with an end cap for receiving the form when folded, the end cap having a hole formed therethrough, the tubular container having a hole formed through a lower end thereof;

a backpack with a divider for receiving both the container and a supplemental component;

a tubular chimney having vertical connecting rods extending upwardly from an upper portion thereof, the tubular chimney having a cap positionable atop the connecting rods, the tubular chimney positionable through the structure after removal of the form, the chimney being formed with radially oriented holes extending through the upper extent of the chimney, the radially oriented holes being disposed beneath where the cap would be positioned atop the connecting rods to allow for the exiting of air from the tubular chimney.

* * * * *